US006166591A

United States Patent [19]

Schultz et al.

[11] Patent Number: 6,166,591

[45] Date of Patent: Dec. 26, 2000

[54] FET GATE BIASING CONTROL DEVICE FOR POWER AMPLIFIER

[75] Inventors: Levi Schultz, D.N.Modiin; Yaron Moas, Rishon LeTzion, both of Israel

[73] Assignee: E.C.I. Telecom Ltd., Petach Tikva, Israel

[21] Appl. No.: 09/209,284

[22] Filed: Dec. 11, 1998

[51] Int. Cl.[7] ..... G05F 1/10

[52] U.S. Cl. ..... 327/544; 327/541

[58] Field of Search ..... 327/427, 430–435, 327/538, 541, 544, 545

[56] References Cited

U.S. PATENT DOCUMENTS

| | | | |
|---|---|---|---|
| 5,089,719 | 2/1992 | Kamei et al. | 327/544 |
| 5,278,517 | 1/1994 | Fujita | 330/279 |
| 5,442,322 | 8/1995 | Kornfeld et al. | 330/285 |
| 5,525,925 | 6/1996 | Bayer | 327/427 |
| 5,585,746 | 12/1996 | Franke | 327/54 |

FOREIGN PATENT DOCUMENTS

| | | | |
|---|---|---|---|
| 9121126 | 5/1997 | Japan | H03F 3/193 |

*Primary Examiner*—Toan Tran

*Attorney, Agent, or Firm*—Edward Langer, Pat. Atty.

[57] ABSTRACT

A novel closed loop FET biasing circuit featuring a standard logic control format for operational mode switching between operating states of an FET power amplifier. In a preferred embodiment, an FET gate bias control device is provided for configuring a gate bias circuit in an FET power amplifier to accommodate a broad range of output power levels, wherein the configuration is responsive to a command which establishes an FET bias condition. The gate bias control device of the present invention comprises a circuit having a controllable switching unit which connects a plurality of resistors in the source-drain voltage circuit portion individually or in parallel to provide a multiple of resistance values each corresponding to one of four amplifier operating modes. The controllable switching unit responds to a set of logic control signals, and therefore greatly simplifies the transition between operating modes, while maintaining FET bias conditions which insure operational stability without problems associated with temperature and loading fluctuations.

19 Claims, 2 Drawing Sheets

FET GATE BIASING CONTROL DEVICE FOR POWER AMPLIFIER

FIELD OF THE INVENTION

The present invention relates to electronic circuits employing field-effect transistors (FET) in amplifier design, and more particularly, to a novel biasing circuit for insuring safe FET operation in applications supporting multiple output power levels and rapid switching between modes of amplifier operation.

BACKGROUND OF THE INVENTION

Power amplifier design using FETs is a well-developed field of electronic circuit design, with the FET defined as a device having a gate electrode and source and drain electrodes. The gate electrode is supplied with a gate bias voltage which in turn sets the bias current (Ids). The bias circuit is completed with the source and drain electrodes, with a source-drain voltage (Vds) applied between them. The optimum operational bias current (Ids) and operational bias voltage (Vds) varies from mode to mode of amplifier operation.

Where FETs are applied in power amplifiers in the telecommunications industry, including portable cellular telephones, a power saving feature is often desirable. This is typically achieved by significant attenuation of the input power level to the amplifier, combined with pinching off the bias current. This shifts the FET operation into a standby mode in response to a transmit/receive command. Additional FET operational states involving adjustment of the input power as well as the source-drain current include a high power state, a reduced power state and a linear, low power state.

Typical design problems associated with operation of an FET in a power amplifier include proper choice of the operating point so that the circuit operates in the linear portion of the FET transfer characteristics in which there is gain. This in known as a biasing problem, in which the gate electrode voltage must be established to allow for dynamic operation within the linear amplification range. This choice is complicated by the need to design the circuit so that the FET does not exceed its maximum power dissipation range, and improper bias design may allow the operating point to shift with temperature in such a way as to burn out the transistor.

The bias problem is further complicated by an unwanted effect known as thermal runaway, which is due to the thermal resistance between the junctions of the transistor and the transistor case. During operation, the power dissipated heats the junction and causes a change in the transistor characteristics, and with unfavorable bias conditions, this in turn causes an increase in the bias current, leading to further overheating. The heat dissipation is also a function of the ambient temperature, and worst case design requires anticipation of these factors.

In telecommunication applications, in addition to the usual problems associated with biasing the FET, the design is further complicated in systems providing time division duplex (TDD) communications and having features such as RF power output control and power saving modes. A complete summary of the design issues is presented as follows:

1) Power On control—high frequency power FET's inevitably require a positive/negative (dual) power source. When the power supply is applied to or disconnected from the unit, the biasing circuit must guarantee that the negative supply is applied to the FET gate electrode before the positive supply appears at the drain electrode. Otherwise, the FET may draw the maximum Ids and self-destruct from oscillations and inability to dissipate the resultant heat buildup.
2) Prevent Thermal Runaway—FET biasing circuits which use the "open loop" method (no current sensing feedback) of adjusting Ids, via application of a voltage divider or adjustable voltage applied to the FET gate electrode, are vulnerable to thermal runaway. As mentioned above, this phenomenon occurs when the FET junction reaches a temperature where the gate voltage no longer regulates the channel conductance and the Ids avalanches to a self-destructing $I_{DSS}$ (saturated drain-source current).
3) Insensitivity to temperature, power supply and device parameter variations—amplifier efficiency, gain and output power capability are all direct functions of Ids. As such, the less sensitive a biasing solution is to the aforementioned variations, the better.
4) Versatility—the biasing scheme must accommodate a number of operational states via appropriate adjustment of the FET Ids:
   a) saturated, high power state (high Ids)
   b) saturated, reduced power state (medium Ids)
   c) linear, low power state (minimal Ids)
   d) standby/Rx (receiving) state—no input/output (FET pinched off)
5) Enable/disable function—TDD operation and power save features require that the FET be transitioned quickly (within several $\mu$s) from the Rx/Standby mode to one of the other three transmission modes.

Existing solutions to the FET biasing problem include an open loop method, which involves adjusting the gate electrode voltage. Since direct measurement of the source-drain current is not easily achieved, the gate electrode voltage Vg is tuned while a more readily measurable parameter, such as output power, is observed. However, this approach is particularly vulnerable to the the thermal runaway problem due to lack of feedback.

Such an open loop method involves using a read-only memory to store gate bias voltage data for selection depending on the type of FET used, with a D/A converter to convert the digital value to an analog voltage for application to the gate electrode, as described in U.S. Pat. No. 5,278,517 to Fujita.

Another solution to the FET biasing problem is a closed loop approach, which provides feedback via a sensing resistor and error amplifier as a direct method of voltage tracking for setting the desired Ids and maintaining this setting over a wide temperature range. This approach, however, requires tracking of the error and when the power is first applied, the integrator delay allows for the possibility of a destructive surge in source-drain current. The integrator delay also prevents rapid transitions between operating modes, and a voltage reference adjustment is needed.

Examples of a direct control, closed loop approach to FET biasing so as to maintain the operating point are described in U.S. Pat. No. 5,442,322 to Kornfeld, U.S. Pat. No. 5,585,746 to Franke, and Japanese patent JP 09121126 A, to Oki Electric Ind. Co. Ltd.

As described above, in light of the many problems associated with biasing the FET in applications where there are different output power levels and rapid mode switching, it would be desirable to provide easily controllable FET biasing and insure safe operation despite temperature and loading fluctuations.

SUMMARY OF THE INVENTION

Accordingly, it is a principal object of the present invention to overcome the disadvantages of the prior art FET biasing methods, and provide a novel closed loop FET biasing circuit featuring a standard logic control format for operational mode switching between operating states of an FET power amplifier.

In accordance with a preferred embodiment of the present invention, there is provided an FET gate bias control device for configuring a gate bias circuit in an FET power amplifier to accommodate a broad range of output power levels, wherein the configuration is responsive to a command which establishes an FET bias condition, the FET gate bias control device including a source-drain voltage circuit portion providing a source-drain voltage between the source and drain electrodes, said FET gate bias control device comprising:

a voltage source means for providing a predetermined voltage in the source-drain voltage circuit portion;

a plurality of fixed resistors being connectable to provide a selectable range of resistance values in the source-drain voltage circuit potion, controllable switching means for connecting said plurality of fixed resistors to select a particular resistance value corresponding to one of four predetermined amplifier operating modes, said selected resistance value establishing a source-drain current level associated with a selected one of said predetermined amplifier operating modes; and control means for controlling said switching means in response to the command, to select said amplifier operating mode.

In the preferred embodiment, the gate bias control device of the present invention comprises a circuit having a controllable switching unit which connects a pair of resistors in the source-drain voltage circuit portion individually or in parallel to provide a multiple of resistance values each corresponding to one of four amplifier operating modes.

The controllable switching unit responds to a set of logic control signals from a controller, and therefore greatly simplifies the transition between operating modes, while maintaining FET bias conditions which insure operational stability without problems associated with temperature and loading fluctuations.

Other features and advantages of the invention will become apparent from the following drawings and description.

BRIEF DESCRIPTION OF THE DRAWINGS

For a better understanding of the invention with regard to the embodiments thereof, reference is made to the accompanying drawings, in which like numerals designate corresponding sections or elements throughout, and in which.

DETAILED DESCRIPTION OF THE PREFERRED EMBODIMENT

Figure 1:
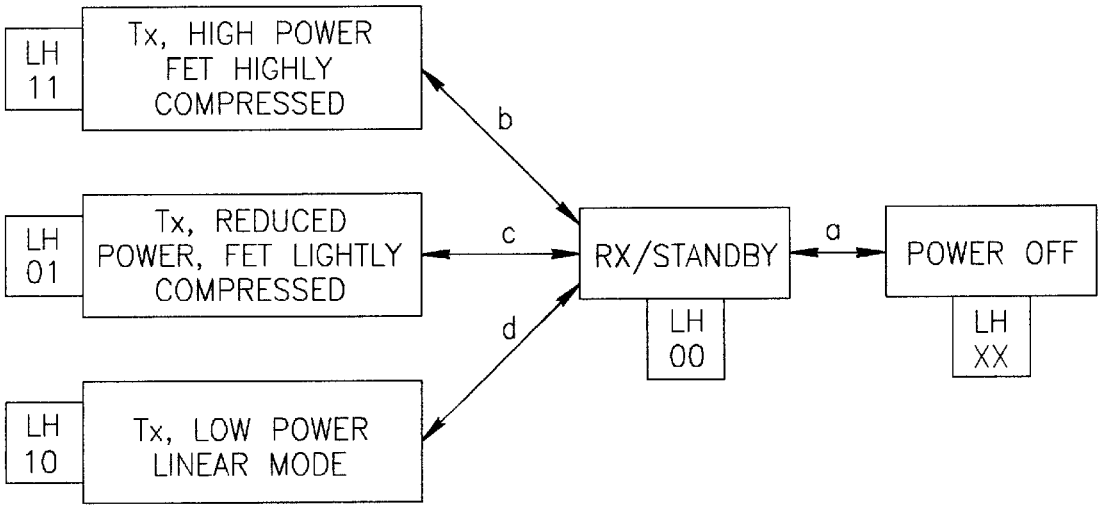
FIG. 1 is a state diagram illustrating the modes of operation of a power amplifier using an FET, applied in a telecommunications application.

Referring now to FIG. 1, there is shown a state diagram illustrating the modes of operation of an FET power amplifier, applied in a telecommunications application. In order to meet the versatility requirements described in the background to the invention, the biasing scheme must accommodate a number of operational states via appropriate adjustment of the FET Ids from a power off mode,to a standby/Rx (receiving) state—transition (a).

An enable/disable function of the telecommunications unit, having TDD operation and power save features, requires that the FET be transitioned quickly (within several $\mu$s) from the Rx/Standby mode to one of the other three transmission modes, noted as transitions b, c and d in the state diagram of FIG. 1.

Each of the transitions b, c and d is from the standby/Rx state to a transmitting state as follows:

Transition—(b) to saturated, high power state (high Ids);
(c) to saturated, reduced power state (medium Ids);
(d) to linear, low power state (minimal Ids).

Figure 2:
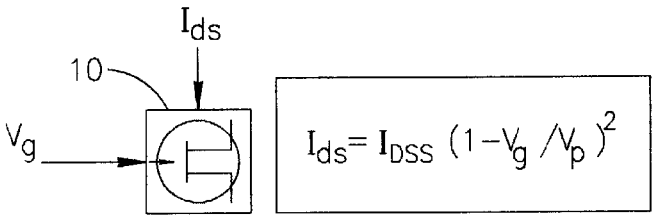
FIG.2 PRIOR ART
FIGS. 2–3 are prior art block diagrams showing, respectively, open loop and closed loop FET bias voltage control.
Figure 3:
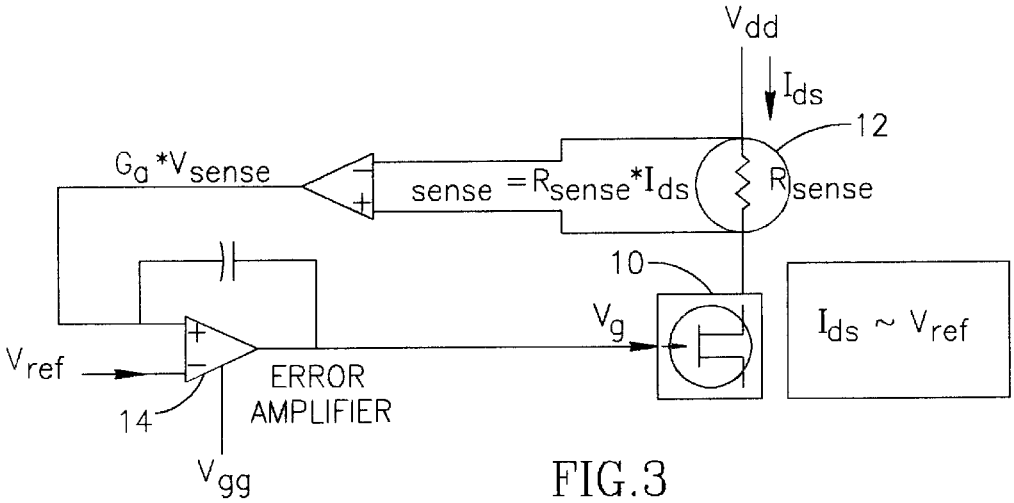
FIG.3 PRIOR ART

In FIGS. 2 and 3, there are shown prior art techniques for biaising an FET 10 in electronic circuits, and these prior art techniques are now discussed.

In FIG. 2, there is shown a prior art open loop method, which involves adjusting the gate electrode voltage Vg with a potentiometer, or adjusting it using a microprocessor-controlled D/A converter, or adjusting it using a pulse-width modulator with a low pass filter to provide an adjustable analog output. Direct measurement of Ids is impractical, therefore the gate electrode voltage Vg is tuned while a more readily measurable parameter, such as output power, is observed. Settings for D/A converters or pulse-width modulators (PWM) can be stored in memory, thus meeting the versatility requirement. The parameters affecting Ids are given in the equation:

$$Ids=I_{DSS}(1-Vg/Vp)^2$$

where Vp=pinch off voltage, i.e., the gate voltage which shuts off the FET, and $I_{DSS}$=maximum current drain when gate voltage is zero.

While this circuit compensates for device and power supply variations, it does not directly address the other requirements. It is particularly vulnerable to the thermal runaway problem due to the lack of feedback.

In FIG. 3, there is shown a prior art closed loop approach, which provides feedback via a sensing resistor 12 and error amplifier 14 as a direct method of voltage tracking for setting the desired Ids and maintaining this setting over a wide temperature range. This approach, however, suffers from the following drawbacks:

1) No 'Power on' Control—on transition (a) from an off state to the receiver standby mode, before the integrator can track the error, a destructive surge of Ids can be drawn through the FET.

2) The integrator prevents rapid transitions between modes as required by the TDD, TDMA (time division multiple access) application.

3) A D/A converter or PWM circuit is required for adjusting Vref.

Figure 4:
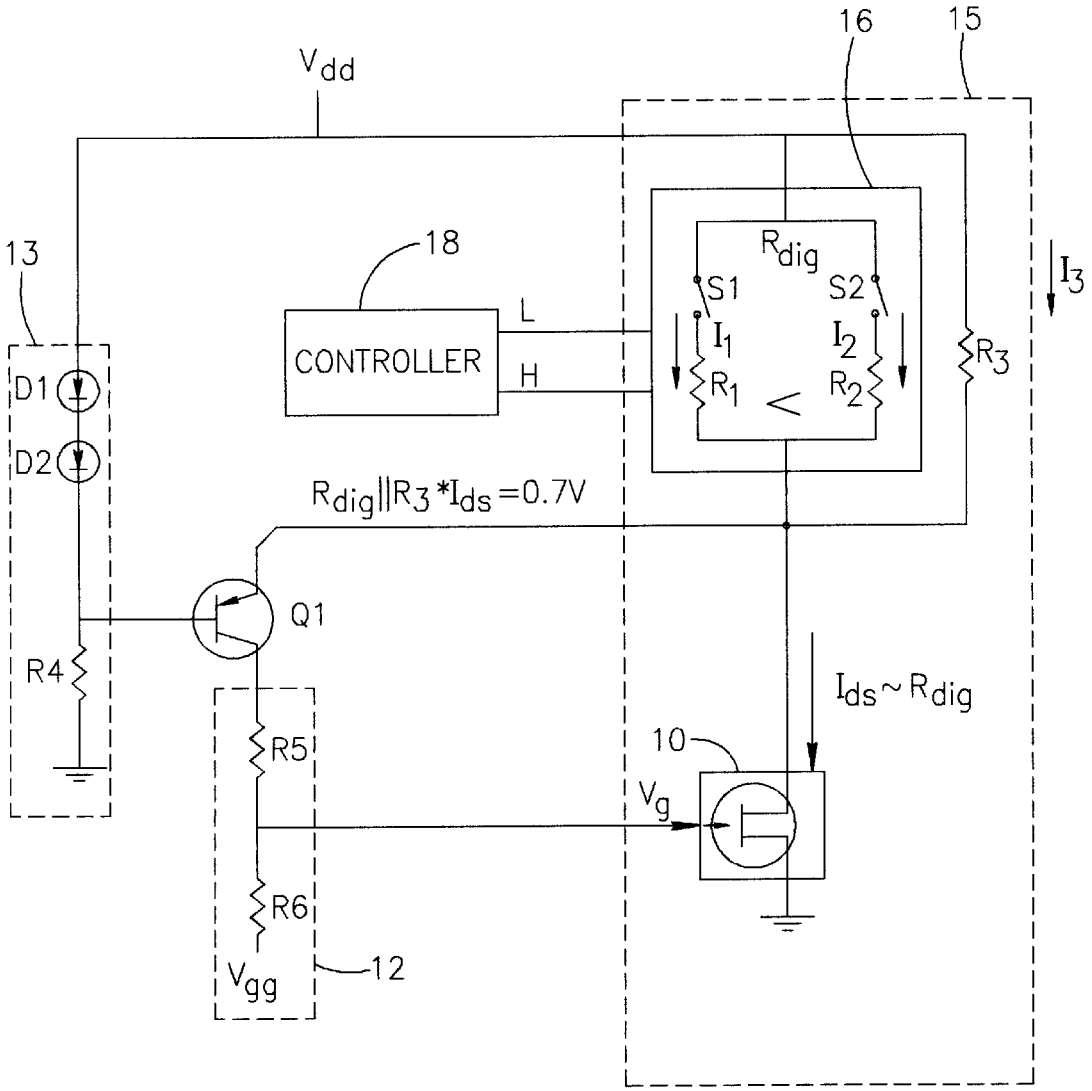
FIG. 4 is an electronic schematic diagram showing a preferred embodiment of a closed loop, resistor tracking circuit providing FET bias voltage control, in accordance with the principles of the present invention; and Table 1 summarizes the operational states of the circuit shown in FIG. 4.

Referring now to FIG. 4, there is shown an electronic schematic diagram showing a preferred embodiment of a closed loop, resistor tracking circuit providing FET bias voltage control, in accordance with the principles of the present invention.

The tracking circuit of FIG. 4 features a pair of series-connected diodes D1, D2 in a voltage divider arrangement 13 with resistor R4, connected to provide a base input voltage to transistor Q1. The collector leg has a voltage divider 12 comprising resistors R5, R6 to Vgg which adjusts the FET gate bias voltage. A source-drain voltage circuit portion 15 has a pair of parallel-connected resistors R1, R2 which form a digitally-controlled resistor 16 (Rdig) having digital switches (S1, S2) which enable standard logic to control its operation using logic input signals L, H from a controller 18.

In operation, diodes D1, D2 and transistor Q1 are biased in the active mode such that a 0.7V drop is imposed across the parallel combination of resistors Rdig and R3. The digital switches in Rdig can be implemented using a dual, p-channel MOSFET, which has a very low ON resistance, on the order of a few tenths of an ohm. Depending on the logic implementation chosen, pulldown/pullup resistors (not shown) connected on the input signal logic lines L and H from controller guarantee that in transition (a), the digital switches S1, S2 remain open, thus protecting the FET, and solving the problem associated with a maximum $I_{DSS}$ surge, which could cause the FET to self-destruct from oscillations and inability to dissipate the resultant heat build up.

In the standby/Rx mode, the digitally-controlled resistor Rdig is very large, effectively disabling the power amplifier. Transistor Q1 is kept in the active mode by resistor R3, which has a value in the range of hundreds of ohms, allowing for fast (b) (c) and (d) transitions, and solves the transition delay problems. For each Rdig value established, the voltage divider in the collector leg of Q1 adjusts the FET gate bias voltage to accommodate the Ids dictated by the value of Rdig. This feedback mechanism renders the circuit insensitive to variation in FET pinchoff characteristics, thus solving the problems associated with manufacturing the FET so as to make it independent of device parameter variations. In addition, it solves the thermal runaway problem.

The level of Ids can be controlled by Rdig, and this provides the versatility required in design of the power amplifier, for the operational states outlined in the background. The value of resistor R3 is chosen so that the current through resistor R3 (I3) is on the order of a few milliamps, while the current through the digital switches (I1, I2) can be adjusted to be on the order of a few hundred milliamps. These operational states can be summarized as shown in Table 1:

| State | L | H | $R_{dig}$ | $I_{ds}$ |
|---|---|---|---|---|
| Standby/Rx | 0 | 0 | ∞ | $I_3$ |
| Tx, Linear, Low Power | 1 | 0 | R2 | $I_2 + I_3$ |
| Tx, Saturated, Reduced Power | 0 | 1 | R1 | $I_1 + I_3$ |
| Tx, Saturated, High Power | 1 | 1 | R1‖R2 | $I_1 + I_2 + I_3$ |

In summary, the present invention provides a gate bias control circuit comprising a controllable switching unit responsive to a set of logic control signals, to greatly simplify the transition between FET operating modes, while maintaining FET bias conditions which insure operational stability without problems associated with temperature and loading fluctuations.

Having described the invention with regard to certain specific embodiments thereof, it is to be understood that the description is not meant as a limitation, since further modifications may now suggest themselves to those skilled in the art, and it is intended to cover such modifications as fall within the scope of the appended claims.

We claim:

1. A configurable FET gate bias control device for enabling an FET power amplifier to accommodate a range of output power levels, wherein the configuration is responsive to a command which establishes an FET bias condition corresponding to one of a plurality of predetermined amplifier operating modes, said FET gate bias control device including a source-drain voltage circuit portion providing a source-drain voltage between the source and drain electrodes, said FET gate bias control device comprising:

a voltage source means connected to the source-drain voltage circuit portion for applying a predetermined voltage thereto;

a plurality of fixed resistors being connectable to provide a selectable range of resistance values in the source-drain voltage circuit portion;

controllable switching means for connecting said plurality of fixed resistors so as to provide a particular resistance value establishing a source-drain current level associated with one of said predetermined amplifier operating modes; and control means for controlling said switching means in response to the command, to select one of said predetermined amplifier operating modes.

2. The device of claim 1 further comprising a first voltage divider having its output connected to the gate electrode of the FET and being arranged to establish an FET gate bias voltage in accordance with said selected amplifier operating mode.

3. The device of claim 2 wherein said FET gate bias voltage associated with said selected amplifier operating mode insures operational stability without temperature and loading fluctuations.

4. The device of claim 1 wherein said controllable switching means comprises:

at least one path having a switching element arranged in series with one of said plurality of fixed resistors, a parallel path to said at least one path having another one of said plurality of fixed resistors being connected in the source-drain voltage circuit portion, said controllable switching means being operable to establish said particular resistance value within said selectable range of resistance values.

5. The device of claim 1 wherein said controllable switching means comprises a plurality of parallel paths each having a switching element arranged in series with one of said plurality of fixed resistors, said parallel paths being connected in the source-drain voltage circuit portion, said controllable switching means being operable to establish said particular resistance value within said selectable range of resistance values.

6. The device of claim 5 wherein each of said switching elements comprises a MOSFET.

7. The device of claim 6 wherein each of said MOSFETs is controllable by a logic circuit which controls MOSFET switching between said amplifier operating modes while insuring each of said MOSFETs normally remains open during power ON/OFF transitions.

8. The device of claim 7 wherein said logic circuit comprises at least one of pullup/pulldown resistors connected to input logic signal lines to maintain said MOSFETs normally open.

9. The device of claim 1 wherein said amplifier operating modes comprise a standby mode, a linear low power mode, a saturated low power mode, and a saturated high power mode.

10. The device of claim 9 applied in a time division duplex (TDD) telecommunications system wherein rapid transition between said operating modes provides a power saving feature.

11. A method of configuring a gate bias circuit in an FET power amplifier to accommodate a range of output power levels, wherein the configuration is responsive to a command which establishes an FET bias condition corresponding to one of a plurality of predetermined amplifier operating modes, said gate bias circuit including a source-drain voltage circuit portion providing a source-drain voltage between the source and drain electrodes, said method comprising the steps of:

applying a predetermined voltage to the source-drain voltage circuit portion;

providing a plurality of fixed resistors being connectable to provide a selectable range of resistance values in the source-drain voltage circuit portion;

connecting said plurality of fixed resistors so as to provide a particular resistance value establishing a source-drain current level associated with one of said predetermined amplifier operating modes; and controlling performance of said connecting step in response to the command, to select one of said predetermined amplifier operating modes.

12. The method of claim 11 further comprising the step of providing a voltage divider arranged to establish an FET gate bias voltage in accordance with said selected amplifier operating mode.

13. The method of claim 12 wherein said FET gate bias voltage associated with said selected amplifier operating mode insures operational stability without temperature and loading fluctuations.

14. The method of claim 11 wherein said connecting step is performed by a controllable switching means comprising switching elements responsive to a logic circuit which controls switching between said amplifier operating modes while insuring said switching elements normally remain open during power ON/OFF transitions.

15. The method of claim 11 wherein said connecting step comprises forming a plurality of parallel paths, at least one having one of said plurality of fixed resistors arranged in series with a switching element, said parallel paths being connected in the source-drain voltage circuit portion, to establish said particular resistance value within said selectable range of resistance values.

16. The method of claim 11 wherein said amplifier operating modes comprise a standby mode, a linear low power mode, a saturated low power mode, and a saturated high power mode.

17. The method of claim 16 applied in a time division duplex (TDD) telecommunications system wherein rapid transition between said operating modes provides a power saving feature.

18. The device of claim 2 further comprising a transistor having its collector electrode connected in series with said first voltage divider to a negative voltage pole, and a second voltage divider having its output connected to a base electrode of said transistor for regulating its base voltage, said second voltage divider being connected between a positive voltage pole and ground via at least one diode, said transistor having its emitter connected to provide feedback from the FET source electrode to the FET gate electrode.

19. A control device for controlling an FET power amplifier (FET) to ensure a range of output power levels by commands ordering to select respective predetermined operating modes of the FET, the control device comprising:

a source-drain voltage circuit portion for providing a source-drain voltage between the source and drain electrodes of said FET;

a gate bias circuit of said FET, interconnected with said source-drain voltage circuit portion to provide therefrom a feedback signal to the gate of said FET;

controllable switching means comprising two or more fixed resistors being connectable to provide a selectable range of resistance values in the source-drain voltage circuit portion in response to said commands, the arrangement being such that any of said commands causes selecting of a corresponding resistance value that leads to establishing a predetermined source-drain current level resulting in turn in a suitable gate bias voltage, thereby providing one of said predetermined operating modes of the FET.

* * * * *